US005626011A

United States Patent [19]

Ballhausen et al.

[11] Patent Number: 5,626,011

[45] Date of Patent: May 6, 1997

[54] METHOD FOR JOINING A THREAD IN A DEVICE FOR MANUFACTURING A TWISTED YARN BY AN INTEGRATED SPINNING AND TWISTING PROCESS AS WELL AS A DEVICE FOR PERFORMING THE METHOD

[75] Inventors: Ulrich Ballhausen, Krefeld; Guido Spix, Kaarst; Wilfried Rütten, Wegberg, all of Germany

[73] Assignee: Palitex Project-Company GmbH, Krefeld, Germany

[21] Appl. No.: 524,177

[22] Filed: Sep. 6, 1995

[30] Foreign Application Priority Data

Sep. 7, 1994 [DE] Germany ..... 44 31 830.8

[51] Int. Cl.[6] ..... D01H 4/00; D01H 1/10

[52] U.S. Cl. ..... 57/409; 57/58.49; 57/58.52; 57/58.7; 57/58.83; 57/59; 57/60; 57/263; 57/279; 57/406; 57/408

[58] Field of Search ..... 57/406, 408, 409, 57/411, 59, 60, 58.49, 58.52, 58.7, 58.83, 263, 279

[56] References Cited

U.S. PATENT DOCUMENTS

| | | | |
|---|---|---|---|
| 4,023,336 | 5/1977 | Krusche et al. | 57/263 |
| 4,118,919 | 10/1978 | Marbacher | 57/279 |
| 4,120,142 | 10/1978 | Franzen | 57/279 |
| 4,127,983 | 12/1978 | Munker | 57/279 |
| 4,185,761 | 1/1980 | Miyazaki et al. | 57/263 |
| 4,680,925 | 7/1987 | Bischofberger et al. | 57/263 |
| 4,754,599 | 7/1988 | Siebert | 57/58.52 |
| 5,479,771 | 1/1996 | Ballhausen et al. | 57/406 |
| 5,499,496 | 3/1996 | Stenmans | 57/406 |

FOREIGN PATENT DOCUMENTS

| | | |
|---|---|---|
| 2354403 | 1/1978 | France . |
| 78710 | 8/1969 | German Dem. Rep. . |
| 2615505 | 10/1977 | Germany . |

*Primary Examiner*—William Stryjewski
*Attorney, Agent, or Firm*—Robert W. Becker & Associates

[57] ABSTRACT

In a method for joining a thread a spindle rotor with hollow spindle shaft is rotatably supported on a machine frame. A radially outwardly extending yarn guide channel is connected to the hollow spindle shaft. Two spinning devices with upwardly open spinning rotors are supported above the spindle rotor symmetrical to the central axis of the spindle rotor. A centering point is positioned on an extension of the central axis of the spindle rotor. A spun yarn is spun in each spinning device from dissolved fiber material and led upwardly away from the spinning rotors, reversed in their direction of movement by 180°, and introduced into the hollow spindle axle. The spun yarns form a yarn balloon between the yarn guide channel and the centering point, and twisted yarn is removed from the centering point. The dissolved fiber material is fed to the spinning devices through the yarn balloon. For each spinning rotor a joining thread is threaded with one end into the hollow spindle axle and with the other into the spinning rotor. A thread loop is generated from each joining thread between the and guided such that a first thread branch is fed into the spinning rotor and the second thread branch is removed through the hollow spindle axle until the thread loop is resolved, the direction of movement of the first thread branch is reversed, and the joining thread is removed through the hollow spindle axle.

16 Claims, 4 Drawing Sheets

METHOD FOR JOINING A THREAD IN A DEVICE FOR MANUFACTURING A TWISTED YARN BY AN INTEGRATED SPINNING AND TWISTING PROCESS AS WELL AS A DEVICE FOR PERFORMING THE METHOD

BACKGROUND OF THE INVENTION

The present invention relates to a method for joining a thread in a device for manufacturing a twisted yarn by an integrated spinning and twisting process. The device comprises at least one spindle rotor with a hollow spindle axle that is rotatably supported on a machine frame. To the hollow spindle axle a yarn guide channel, extending substantially radially outwardly, is connected for a yarn which, after exiting from the yarn guide channel under formation of a yarn balloon, is guided to a centering point positioned on an extension of the hollow spindle axle from which centering point the yarn is removed. The device further includes a device for feeding dissolved fiber material into the space enclosed by the yarn balloon.

The invention also relates to a device for performing the inventive method.

It is known to manufacture a twisted yarn such that in a first working step are further machined with a suitable spinning device spun yarns are produced which in a subsequent working step with twisting devices, for example, a two-for-one twisting device, to produce a twisted yarn.

From printed documents DD 78 710 and French Publication 2 354 403 devices are known which produce with two neighboring, i.e., adjacently arranged spinning devices or spinning devices arranged atop one another, individual spun yarns which directly after spinning are gathered and subjected to twisting.

A very important step with such a device is the joining of the thread during the initial start-up of the device.

Known thread-joining devices for generating the individual spun fibers with a rotor spinning device operate with an auxiliary thread or the free end of the spun yarn which, with the aid of a suitable automatic device, is guided through the central spun fiber channel into the spinning rotors such that its free end is joined with the fibers positioned within the rotor groove and is then retracted upon reversing the automatic device so that the continuous spinning process is started and continued.

For the conventional joining technique a forward and rearward movement of the joining thread is thus needed. This requires a complicated mechanical device and especially an exactly operating reversing control device.

It is therefore an object of the present invention to provide a method and a device with which in a simple manner, without complicated mechanical devices and without a separate reversing control, the aforedescribed method of joining the thread can be performed in a device for manufacturing a twisting yarn by an integrated spinning and twisting process.

SUMMARY OF THE INVENTION

The method for joining a thread in a device for manufacturing a twisted yarn with an integrated spinning and twisting process according to the present invention is primarily characterized by:

providing at least one spindle rotor with hollow spindle shaft rotatably supported on a machine frame;

connecting a radially outwardly extending yarn guide channel to the hollow spindle shaft;

supporting at least two spinning devices with upwardly open spinning rotors above the spindle rotor such that the spinning devices are located adjacent to one another and symmetrical to a central axis of the spindle rotor;

positioning a centering point on an extension of the central axis of the spindle rotor above the spindle rotor;

spinning a spun yarn in each one of the spinning devices from dissolved fiber material;

leading the spun yarn of each of the spinning devices upwardly away from the spinning rotors and reversing their direction of movement by 180° for introduction into the hollow spindle axle provided as an upward extension of the hollow spindle shaft;

guiding the spun yarns through the hollow spindle axle, the yarn guide channel, and the centering point while forming a yarn balloon between the yarn guide channel and the centering point;

removing the yarn from the centering point;

feeding the dissolved fiber material to the spinning devices through the yarn balloon;

threading for each one of the spinning rotors a joining thread with one end into the hollow spindle axle and with the other end into the spinning rotor;

generating a thread loop of a preset length from each joining thread in an area between the inlet of the hollow spindle axle and the spinning rotor;

guiding each thread loop such that a first thread branch thereof is fed into the spinning rotor and simultaneously removing the second thread branch through the hollow spindle axle until the thread loop is resolved and the movement of the first thread branch is reversed and the entire joining thread is removed through the hollow spindle axle.

Advantageously, the method further comprises the step of clamping the middle of the thread loop such that a transmission of spinning rotations is prevented until the thread loop is resolved.

The present invention also relates to a device for joining a thread in a device for manufacturing a twisted yarn by an integrated spinning and twisting process. The inventive device is primarily characterized by:

at least one spindle rotor with a hollow spindle axle rotatably supported on a machine frame;

a radially outwardly extending yarn guide channel connected to the hollow spindle axle;

at least two spinning devices with upwardly open spinning rotors supported above the spindle rotors such that the spinning devices are located adjacent to one another and symmetrical to a central axis of the spindle rotor, wherein each one of the spinning devices spins a spun yarn from dissolved fiber material;

a hollow spindle axle connected to the upper end of the hollow spindle shaft;

a centering point positioned on an extension of the central axis of the spindle rotor above the spindle rotor, wherein the spun yarns are introduced for twisting into the hollow spindle axle, subsequently the spun yarns are guided through the hollow spindle axle, the yarn guide channel, and the centering point while forming a yarn balloon between the yarn guide channel and the centering point, where the twisted yarn is removed;

a means for feeding the dissolved fiber material to the spinning devices through the yarn balloon;

one guide element positioned above each one of the spinning devices in an area between an extension of a rotational axis of the spinning rotor and the central axis of the spindle rotor, wherein the spun yarn of each of the spinning devices is led upwardly away from the spinning rotors to the guide elements for reversing the direction of movement by 180° and introduction into the hollow spindle axle;

at least one storage element positioned in the vicinity of the guide elements for storing a thread loop of a preset length of a joining thread to be introduced into the spinning rotors from the hollow spindle axle;

means for securing the thread loop;

means for sequentially releasing the thread loop until the thread loop is resolved;

means for transferring the joining thread to the guide element after resolving the thread loop.

Preferably, the storage element comprises a clamping device for clamping the middle of the thread loop and for releasing the thread loop after resolving the thread loop.

Advantageously, the device comprises two of the storage elements wherein each one of the spinning rotors has coordinated therewith one of the storage elements. Each one of the guide elements is preferably located below the storage element coordinated therewith.

Expediently, the device has one of the storage elements for common use by both guide elements.

Preferably, the guide elements are located in an area below the storage element.

In a preferred embodiment of the present invention the storage element is a freely rotatable storage wheel having at its periphery a yarn guide groove and a hook positioned within the yarn guide groove for securing the thread loop. The thread loop is guided from below across a portion of the guide element into the yarn guide groove at a side thereof facing the extension of the rotational axis of the spinning rotors.

Preferably, the hook is a clamping hook for clamping the thread loop within the yarn guide groove.

The storage wheel has an adjustable braking device for preventing accidental free rotation of the storage wheel.

In yet another embodiment of the present invention the guide element is a freely rotatable guide pulley having an axis of rotation extending parallel to the axis of rotation of the storage wheel.

Preferably, a diameter of the guide pulley is smaller than a diameter of the storage wheel.

In another embodiment of the invention the guide element is a freely rotatable guide pulley having an axis of rotation extending coaxially to the axis of rotation of the storage wheel. The guide pulley is preferably fixedly connected to the storage wheel. The diameter of the guide pulley is preferably smaller than the diameter of the storage wheel.

The invention is based on the principle that the thread-joining process is started up such that for joining the thread two joining threads are threaded into the conventional thread path of the two-for-one twisting spindle. This can be achieved manually with the aid of a mechanical threading device or can be performed with known methods and devices operating by pneumatic threading. Each of the two threaded joining threads is then guided from the upper end of the hollow spindle axle via part of the circumference of a guide element and via a storage element from the top into the respective spinning rotor. By doing so a thread loop of a preset length is stored within the storage element. This makes it possible that during startup of the spinning rotors at first this stored thread loop is withdrawn from the storage element into the spinning rotor. The thread loop is subsequently released from the storage element and, after thread joining, the joining thread together with the joined spun yarn can be removed from the spinning rotor, its direction being reversed, by being guided over the guide element into the hollow spindle axle.

It has been demonstrated that the inventive method with its joining device can be performed very simply by using a freely rotatable storage wheel as a storage element which comprises a yarn guide groove and a clamping hook arranged therein for fixing and clamping the aforementioned thread loop. As will be explained in the following with the aid of a specific example, in such an arrangement the loop must only be guided over a portion of the circumference of the storage wheel and suspended at the clamping hook. Upon drawing the joining thread into the spinning rotor, the thread loop is withdrawn and the storage wheel is rotated until the thread loop can slip out of the downwardly oriented clamping hook after a certain rotation. The joining thread, after release of the thread loop, is placed, for example, onto the freely rotatable guide pulley with which after reversal of direction of movement the thread and the spun yarn is guided to the hollow spindle axle. The spun yarns are united in the hollow spindle axle and the twisting process is started.

By clamping the thread loop a limitation of the vertex point of the thread loop is achieved during storage, but another additional advantageous effect results also. During the joining process the free end of the joining thread is at the same time subjected to a twist within the spinning rotor. This twist would, in general, be transmitted through the inserted joining thread to the central inlet into the twisting portion of the device, i.e., into the hollow spindle axle of the spinning and twisting device. Due to this twisting energy transmitted to the inlet the two spun yarns coming from the spinning rotors would already be twisted which is undesirable because the twist which will occur later in the process would thus be impeded. Due to the clamping point during storage such a transmission of this twist is prevented.

BRIEF DESCRIPTION OF THE DRAWINGS

The object and advantages of the present invention will appear more clearly from the following specification in conjunction with the accompanying drawings, in which.

DESCRIPTION OF PREFERRED EMBODIMENTS

The present invention will now be described in detail with the aid of several specific embodiments utilizing FIGS. 1 through 7, In the following a conventional device for manufacturing a twisted yarn by an integrated spinning and twisting process will be disclosed in connection with FIG. 1 which device is a two-for-one twisting spindle whereby the components responsible for joining are not shown in this Figure.

Figure 1:
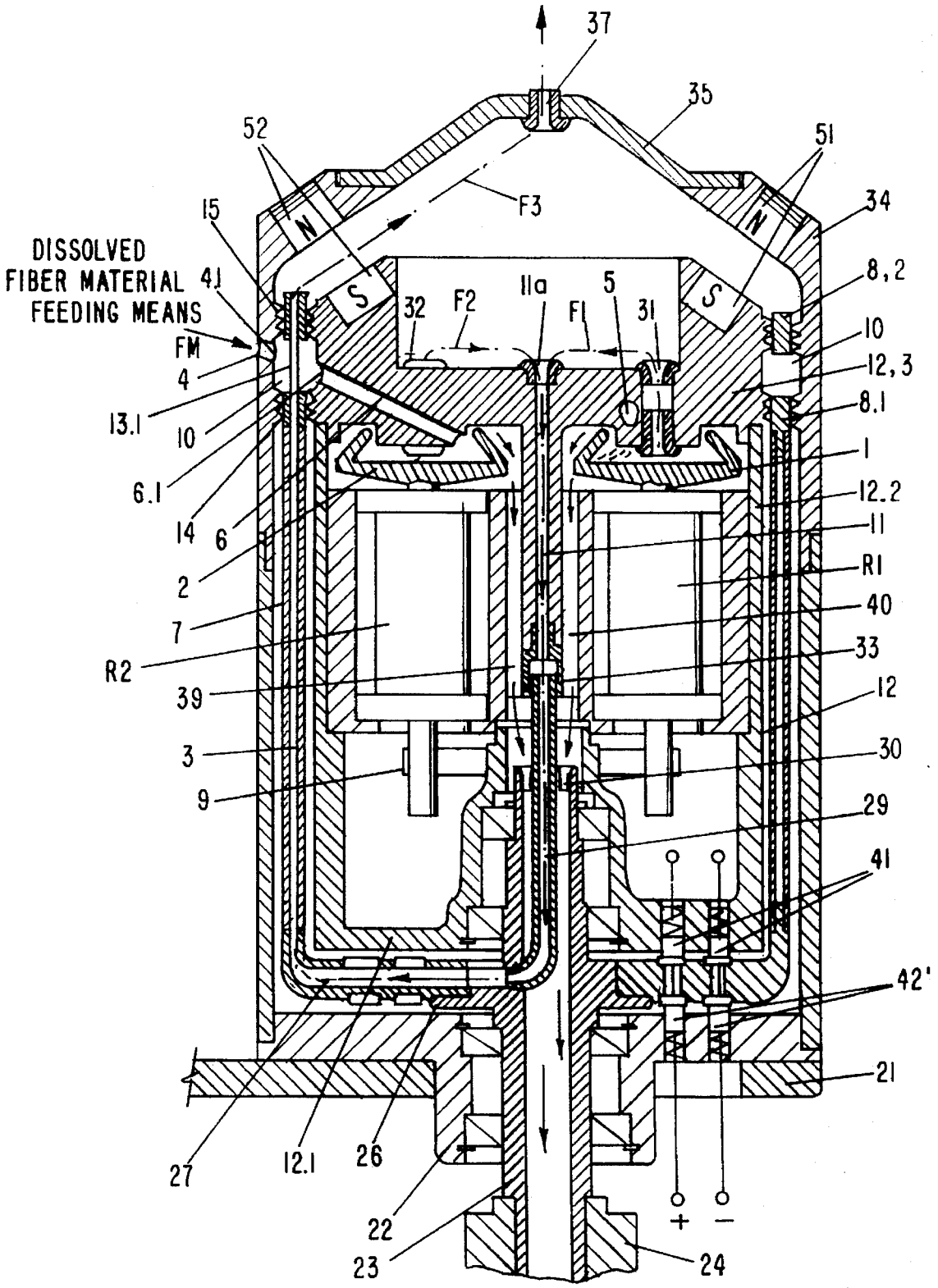
FIG. 1 shows in section a two-for-one twisting spindle with integrated spinning devices in the form of spinning rotors without a joining device.

In the two-for-one twisting spindle of FIG. 1 a hollow spindle shaft 23 is rotatably supported in a spindle rail 21, which represents the machine frame, via a bearing block 22, whereby the hollow spindle shaft 23 can be connected with its outer, i.e., lower end, to a non-represented suction air source. The hollow spindle shaft 23, which can be driven by a whorl 24 and a non-represented tangential belt drive, represents a portion of the spindle rotor and is provided with a radially outwardly oriented spindle rotor disk 26 with a substantially radially extending yarn guide channel 27. To the outer circumference of the spindle rotor disk 26 a balloon limiter 7 is connected. A yarn guide tube 3 is guided along its wall in the upward direction which tube 3 is connected with its lower end to the yarn guide channel 27 and from the upper end of which the yarn F3 exits in the direction toward the centering point 37. Into the inner end of the yarn guide channel 27 a yarn guide tube 29, having its lower end bent, opens whereby this tube 29 is inserted into the hollow spindle shaft 23 such that between the hollow spindle shaft 23 and the yarn guide tube 29 air channels 30 remain open. The spindle rotor is thus comprised essentially of the following components:

Hollow spindle shaft 23, spindle rotor disk 26, balloon limiter 7 with yarn guide tube 3 and yarn guide tube 29.

At the upper end of the hollow spindle shaft 23 an inner housing 12 is supported with interposition of suitable bearings. This housing is essentially closed and secured against rotation by permanent magnet pairs 51, 52. The housing has substantially the shape of a cylinder and comprises a bottom 12.1, an exterior wall 12.2, and a cover 12.3.

Within this inner housing 12 two rotor spinning devices R1 and R2 are arranged having spinning rotors 1 and 2 which are open in the upward direction and which are driven with drive belts 9 by a non-represented motor. Fiber material feed tubes 5 and 6 are guided through the cover 12.3 which open into the spinning rotors 1 and 2. Furthermore, yarn removal tubes 31 and 32 are guided coaxially above the spinning rotor axis through the cover 12.3 through which the spun fibers F1, F2 are removed from the spinning rotors 1 and 2 before being introduced via the upper inlet 11*a* into the downwardly extending hollow spindle axle 11 which opens via interposition of, for example, an annular gap sealing 33 into the upper end of the yarn guide tube 29.

Air channels 39, 40 are connected to the inner end of the hollow spindle shaft 23 which open into the interior of the inner housing 12 in the area of the spinning rotors 1 and 2.

The outer end of the hollow spindle shaft 23 is connected in a non-represented manner to a suction (vacuum) source so that via the hollow spindle shaft 23 and the air channels 39, 40 in the interior space of the inner housing 12 a vacuum can be generated which acts within the fiber material feed tubes 5 and 6 and which effects the fiber feed to the spinning rotors 1 and 2.

The inner housing 12 is surrounded by an exterior housing 34 which comprises a detachable lid 35 in which the permanent magnet pairs 51, 52, cooperating with respective counter magnets within the lid 12.3 of the inner housing, are arranged so that a contact-free securing between the inner housing 12 and the components fixedly connected thereto, on the one hand, and the exterior housing 34, on the other hand, is provided. At the upper side of the lid 35 of the exterior housing 34 a centering point in the form of a yarn outlet opening 37 is provided so as to be coaxially positioned relative to the spindle hollow axle, whereby a removal or winding device for the twisted yarn F3 is positioned downstream thereof.

The energy supply of the drive motors for the rotor spinning devices R1 and R2 is carried out through the spindle rotor disk 26 via a schematically represented system of slip ring contacts 41, 42 with non-represented electrical lines connected thereto.

For feeding the fiber material, the outer housing 34 is provided with fiber material feed channels 4 one of which is visible in FIG. 1. The fiber material feed channel 4 comprises an outlet opening 4.1 opening into the annular chamber 10. Arranged opposite thereto in a staggered arrangement is an inlet opening 6.1 of the fiber material feed tube 6 within the lid 12.3 of the inner housing 12. The annular chamber 10 is delimited at its upperside and underside by annular parts 8.1 and 8.2 which are components of a rotating device that is arranged at the upper end of the balloon limiter 7 and thus rotates with it. The two annular parts 8.1 and 8.2 are connected via spoke-like or column-like connecting elements to one another. Through one of these connecting elements 13.1 the yarn guide tube 3 for the yarn F3 is guided. It is easily recognizable that the supplied fiber material flow FM enters via the outlet opening 4.1 through the annular chamber 10 the inlet opening 6.1 as long as the passage is not covered by one of the connecting elements such as 13.1.

The fiber material to be supplied is conveyed via the fiber material feed channels 4 and the fiber material feed channels 5 and 6 by vacuum. The vacuum present within the interior chamber of the inner housing 12 extends via the fiber material feed tubes 5 and 6 into the annular chamber 10. In order to allow for the generation of a sufficient vacuum within this annular chamber, the gaps via which the annular chamber 10 communicates with spaces at higher pressure between the exterior wall of the inner housing 12 and the inner wall of the housing 34 are provided with gap seals 14, 15.

Figure 2:
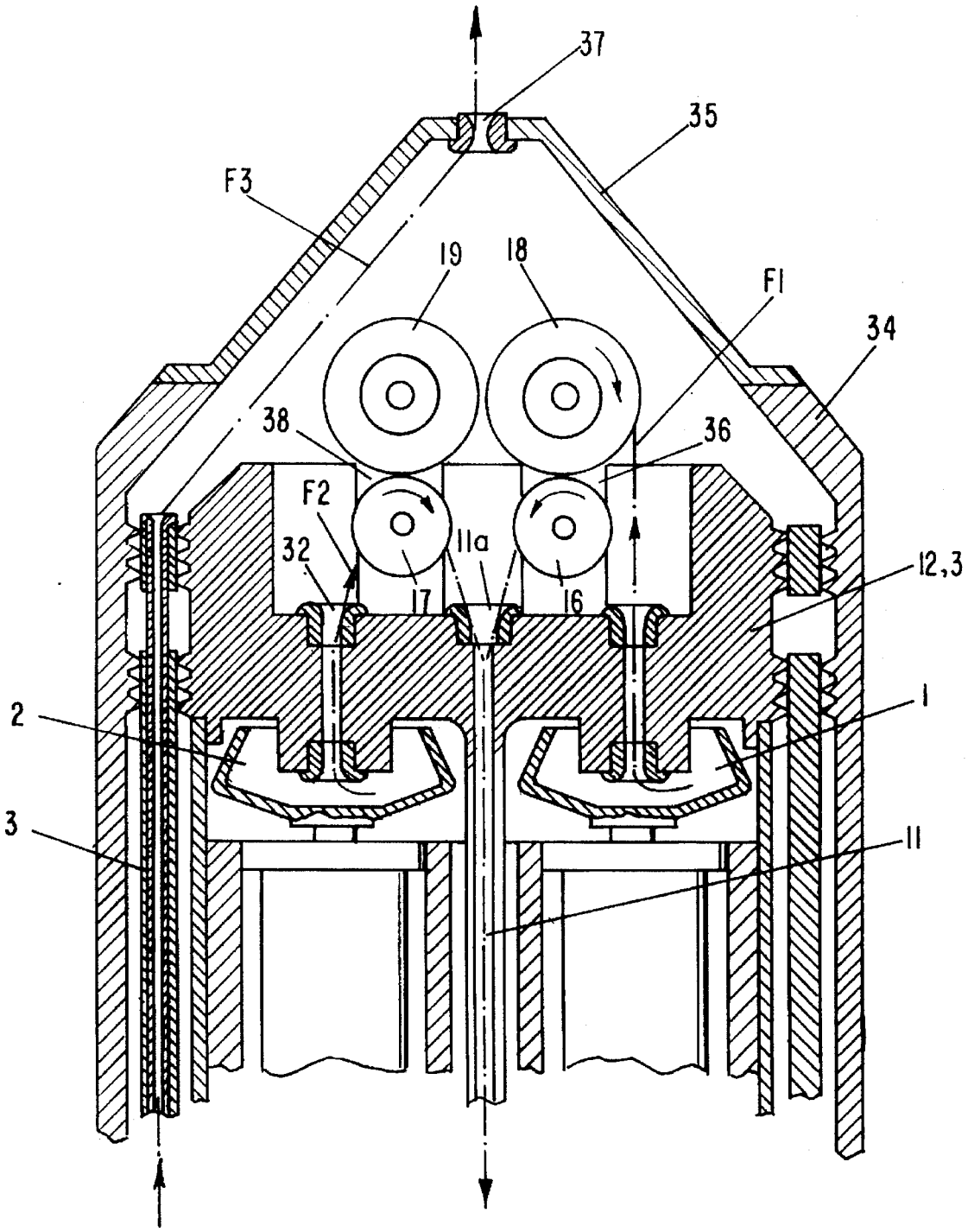
FIG. 2 shows a part-sectional view of the upper half of the device of FIG. 1 with a joining device arranged above the spinning rotors.

With the aid of FIG. 2 a joining device will be described in the following which is placed onto the lid 12.3 of the inner housing 12 of the device of FIG. 1. In FIG. 2 all of the parts which correspond to the parts of the two-for-one twisting spindle of FIG. 1 are indicated with same reference numerals. Parts which are not represented in FIG. 2 are identical to the parts of the two-for-one twisting spindle of FIG. 1.

Above the two spinning rotors 1 and 2 two holders 36 and 38 are arranged at the lid 12.3 which support each a guide pulley 16, 17. A spun yarn F1 is guided, after the joining process, from the first spinning rotor 1 through the fiber removal tube 31 across the guide pulley 16 and, after being deflected by 180°, is introduced into the inlet opening 11*a* of the hollow spindle axle 11. In the same manner, the spun yarn F2 coming from the spinning rotor 2 via the yarn removal tube 32 is deflected by the guide roller 17 by 180° and is guided into the inlet opening 11*a* of the hollow spindle axle 11. In FIG. 2, in the left half of the drawing, the spun yarn F2 is represented such that it extends across the guide pulley 17 in the manner in which it is being guided after the joining process. In the right half of the drawing the spun yarn F1 extending across the guide pulley 16 is represented in the state during the joining process which will be explained in detail with the aid of FIGS. 3 and 4A to 4D in the following.

Above the guide pulleys 16 and 17 a storage wheel 18 and 19 is arranged at the holders 36 and 38. The axis of the guide pulleys and the storage wheels are positioned vertically above one another and are oriented in the same direction. The diameter of the guide pulleys 16, 17 is substantially smaller than the diameter of the storage wheels 18, 19, as shown in the drawings.

Figure 3:
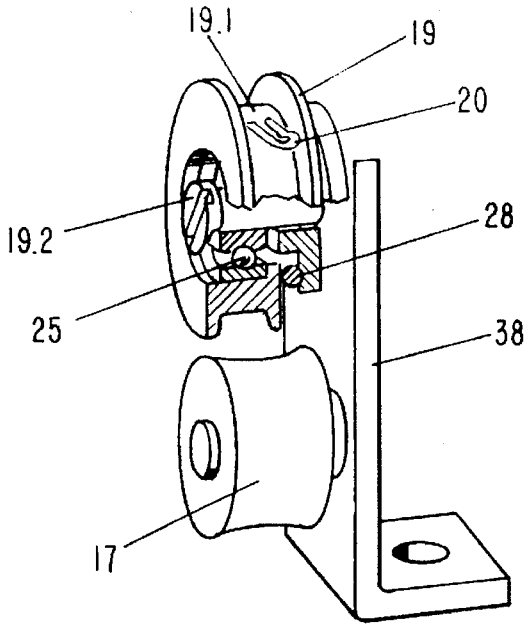
FIG. 3 shows in a slightly enlarged perspective detail one of the adjoining devices of FIG. 2.

The storage wheel 19 is shown in more detail in FIG. 3. The storage wheel 18 is of an analogous construction.

The storage wheel 19 comprises a yarn guide groove 19.1 in which a clamping hook 20 is arranged. Furthermore, the storage wheel 19 is supported via ball bearing 25 on an axle connected to the holder 38. With brake rings 28 which are positioned between the side surface of the storage wheel 19 facing the holder 38 and the holder 38, an accidental free rotation of the storage wheel is prevented. The pressure of the storage wheel 19 onto the brake ring 28 can be adjusted as desired with fastening screw 19.2 of the storage wheel.

In the following the joining process will be explained in more detail with the aid of FIGS. 2, 3 as well as 4A to 4D.

Figure 4A:
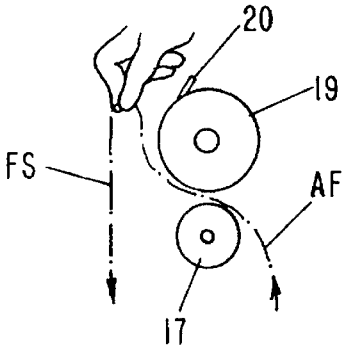
FIGS. 4A to 4D show in four sequential phases in a schematic representation the course of the joining thread through the joining device of FIGS. 2 and 3 during joining.
Figure 4B:
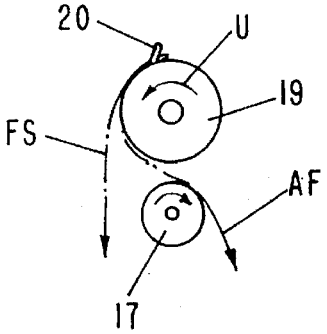

For the joining process a joining yarn comprised of two individual threads is manually or with a non-represented pneumatic threading device guided and threaded through the hollow spindle axle 11, the yarn guide tube 29, the yarn guide channel 27, and the yarn guide tube 3 and guided to the centering point 37. The end of the thread 11*a* extending from the hollow spindle axle 11 of the joining yarn AF, as, for example, represented in FIG. 4A, is positioned across a portion of the circumference of the guide roller 17 and a thread loop FS is guided upwardly, inserted into the yarn guide groove 19.1, and suspended from the clamping hook 20. The free end of the yarn loop FS as is indicated by the downwardly pointing arrow, is inserted into the non-represented spinning rotor 2. This step, as indicated in FIG. 4A, can be performed manually. However, it can also be performed by an automated device. In FIG. 4B the startup process of the joining process is shown. On the one hand, the removal of the joining thread AF through the spindle hollow axle takes place so that the storage wheel 19 is rotated in the direction of arrow U against the braking action of the braking ring 28. Due to this rotation a certain length of the loop FS is freed in the direction toward the spinning rotor (left arrow in FIG. 4B). The direction of movement of the yarn in FIG. 4B is thus in the downward direction at both ends of the yarn.

Figure 4C:
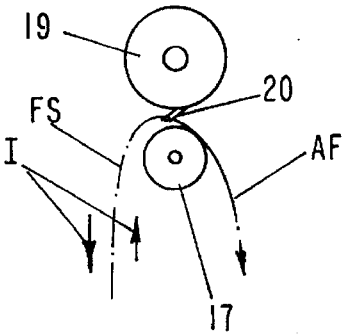

As shown in FIG. 4C, after passing through a certain rotational angle the clamping hook 20 reaches the underside of the storage wheel 19 so that the thread loop FS is released from the clamping hook 20. At this moment, the free end of the joining thread within the spinning rotor 2 is in a state just before reversal of its direction of movement. This indifferent state is indicated in the direction of the spindle rotor with two oppositely arranged arrows I. The removal of the thread into the hollow spindle axle is unchanged as indicated by arrow AF.

Figure 4D:
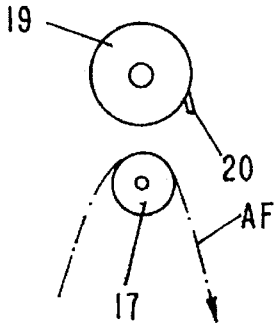

FIG. 4D shows the completed joining process. The thread loop FS is completely removed from the storage wheel and the strand of yarn coming from the spinning rotor now rests on the upper side of the guide pulley 17 which, for an improved guiding of the yarn, is provided with a groove. The strand of yarn now only has a direction of movement in the direction of arrow AF toward the spindle hollow axle.

With this cycle the joining process is complete. The same process has been performed simultaneously at the joining device including storage wheel 18 and guide pulley 16.

Figure 5A:
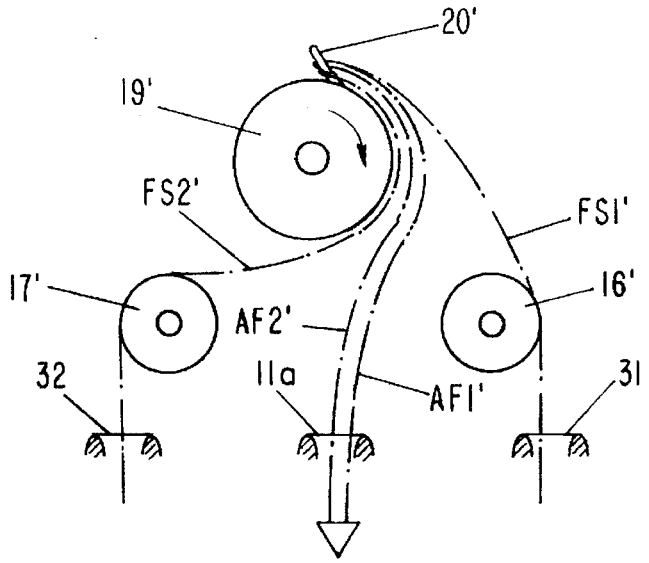
FIGS. 5A and 5B show in two sequential phases in a schematic representation the course of the joining thread through the joining device in which the two spinning rotors have a common storage wheel.
Figure 5B:
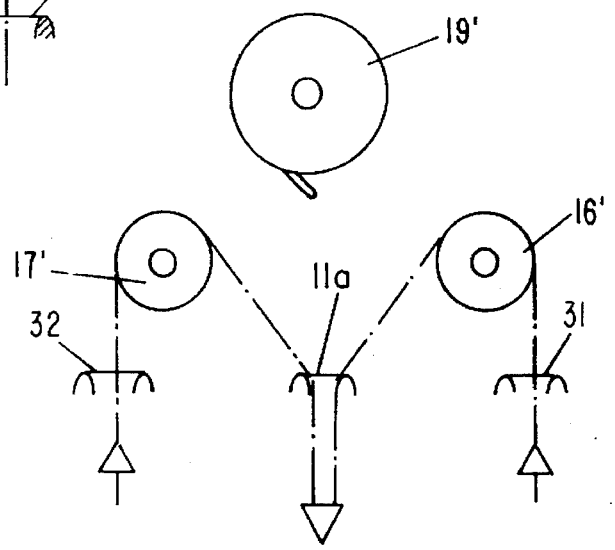

In FIGS. 5A and 5B a joining device is represented which can be positioned onto the lid 12.3 of the inner housing 12 of the device of FIG. 1 instead of the joining device explained in connection with FIGS. 3 to 4D. This joining device differs from the aforedescribed joining device in that the two spinning rotors 1 and 2 have respectively coordinated therewith a guide pulley 16' and 17' which cooperate with a common storage wheel 19'. In this design the axis of the guide pulleys and of the storage wheel are not positioned vertical above one another but are staggered in the horizontal direction relative to one another. The storage wheel 19' is designed identical to the storage wheel 19 of FIG. 3 and comprises a clamping hook 20' into which the thread loop FS1' and FS2' can be hooked. The free ends of the thread loops FS1' and FS2' are inserted in the aforedescribed manner into the removal tubes 31 and 32 of the spinning rotors 1 and 2. The joining threads AF1' and AF2' extend via the inlet opening 11*a* into the hollow spindle axle 11. The functioning of this joining device is the same as disclosed in connection with FIGS. 4A to 4D.

Figure 6:
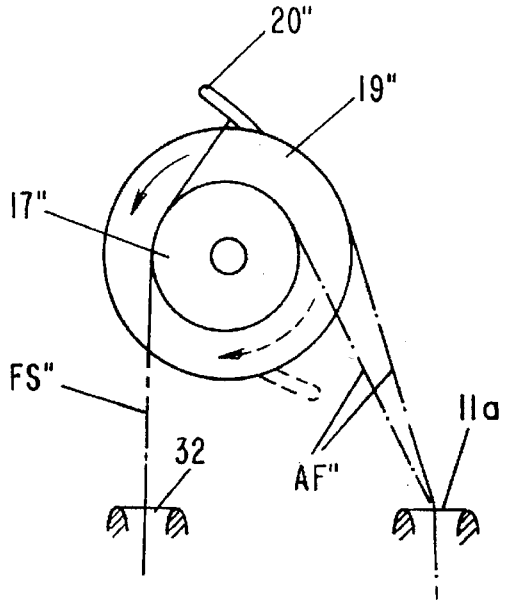
FIG. 6 shows the course of the joining thread through the joining device having a guide pulley and a storage wheel arranged coaxially to one another.
Figure 7:
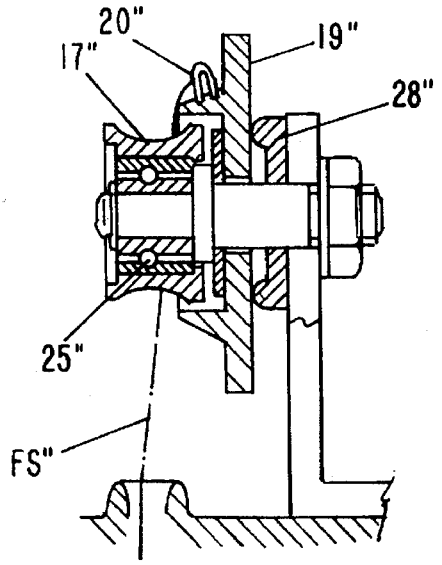
FIG. 7 shows an axial section of the joining device of FIG. 6.

A further embodiment of a joining device is represented in FIGS. 6 and 7 and differs from the joining device of FIGS. 2 and 3 in that the guide pulleys 17" extends coaxially to the storage wheel 19". The guide pulley 17" is freely rotatably supported on its axle with a bearing 25" while one of the side surfaces of the storage wheel 19" rests in the aforedescribed manner at a brake ring 28". The storage wheel 19" is provided with a clamping hook 20" into which the thread loop FS" can be inserted in the aforedescribed manner. The function of the spinning device is in principle the same as the function of the aforedescribed embodiments and can be easily understood in connection with FIG. 6. The joining thread AF" falls, after release from the clamping hook 20", onto the guide pulley 17". In this embodiment each one of the spinning rotors is provided with its own storage wheel.

Of course, in this design it is in principle also possible to provide the guide pulley and storage wheel so as to be fixed to one another or to be of a unitary construction.

The present invention is, of course, in no way restricted to the specific disclosure of the specification and drawings, but also encompasses any modifications within the scope of the appended claims.

What we claim is:

1. A method for joining a thread in a device for manufacturing a twisted yarn with an integrated spinning and twisting process, said method comprising the steps of:

providing at least one spindle rotor with hollow spindle shaft rotatably supported on a machine frame;

connecting a radially outwardly extending yarn guide channel to the hollow spindle shaft;

supporting at least two spinning devices with upwardly open spinning rotors above the spindle rotor such that the spinning devices are located adjacent to one another and symmetrical to a central axis of the spindle rotor;

positioning a centering point on an extension of the central axis of the spindle rotor above the spindle rotor;

feeding the dissolved fiber material to the spinning devices;

spinning a spun yarn in each one of the spinning devices from dissolved fiber material;

threading for each one of the spinning rotors a joining thread with one end into the hollow spindle axle and with the other end into the spinning rotor;

generating a thread loop of a preset length from each joining thread in an area between the inlet of the hollow spindle axle and the spinning rotor;

guiding each thread loop such that a first thread branch thereof is fed into the spinning rotor for catching a leading end of the spun yarn and simultaneously removing the second thread branch through the hollow spindle axle until the thread loop is resolved and the movement of the first thread branch is reversed and the entire joining thread is removed together with the spun yarn through the hollow spindle axle;

leading the spun yarn of each of the spinning devices upwardly away from the spinning rotors and reversing their direction of movement by 180° for introduction into the hollow spindle axle provided as an upward extension of said hollow spindle shaft;

guiding the spun yarns through the hollow spindle shaft, the yarn guide channel, and the centering point while forming a yarn balloon between said yarn guide channel and said centering point through which the dissolved fiber material is guided; and removing the yarn from the centering point.

2. A method according to claim 1, wherein said step of guiding each thread loop includes the step of clamping the middle of the thread loop such that a transmission of spinning rotations is prevented until the thread loop is resolved.

3. A device for joining a thread in a device for manufacturing a twisted yarn with an integrated spinning and twisting process, said device comprising:

at least one spindle rotor with a hollow spindle shaft rotatably supported on a machine frame;

a radially outwardly extending yarn guide channel connected to said hollow spindle shaft;

at least two spinning devices with upwardly open spinning rotors supported above said spindle rotor such that said spinning devices are located adjacent to one another and symmetrical to a central axis of said spindle rotor, wherein each one of said spinning devices spins a spun yarn from dissolved fiber material;

a hollow spindle axle connected to an upper end of said hollow spindle shaft;

a centering point positioned on an extension of said central axis of said spindle rotor above said spindle rotor, wherein the spun yarns are introduced for twisting into said hollow spindle axle, subsequently the spun yarns are guided through said hollow spindle shaft, said yarn guide channel, and said centering point while forming a yarn balloon between said yarn guide channel and said centering point, where the twisted yarn is removed;

a means for feeding the dissolved fiber material to said spinning devices through the yarn balloon;

one guide element positioned above each one of said spinning devices in an area between an extension of a rotational axis of said spinning rotor and said central axis of said spindle rotor, wherein the spun yarn of each of said spinning devices is led upwardly away from said spinning rotors to said guide element for reversing their direction of movement by 180° and introduction into said hollow spindle axle;

at least one storage element positioned in the vicinity of said guide elements for storing a thread loop of a preset length of a joining thread to be introduced into said spinning rotors from said hollow spindle axle;

said at least one storage element comprising means for securing the thread loop, means for sequentially releasing the thread loop until the thread loop is resolved, and means for transferring the joining thread to said guide element after resolving the thread loop.

4. A device according to claim 3, wherein said storage element comprises a clamping device for clamping the middle of the thread loop and for releasing the thread loop after resolving the thread loop.

5. A device according to claim 3, comprising two of said storage elements wherein each one of said spinning rotors has coordinated therewith one of said storage elements.

6. A device according to claim 5, wherein each one of said guide elements is located below said storage element coordinated therewith.

7. A device according to claim 3, having one said storage element for common use by said guide elements.

8. A device according to claim 7, wherein said guide elements are located in an area below said storage element.

9. A device according to claim 3, wherein said storage element is a freely rotatable storage wheel having at its periphery a yarn guide groove and a hook positioned within said yarn guide groove for securing the thread loop, guided from below across a portion of said guide element into said yarn guide groove at a side thereof facing the extension of said rotational axis of said spinning rotors.

10. A device according to claim 9, wherein said hook is a clamping hook for clamping the thread loop within said yarn guide groove.

11. A device according to claim 9, wherein said storage wheel has an adjustable braking device for preventing accidental free rotation of said storage wheel.

12. A device according to claim 9, wherein said guide element is a freely rotatable guide pulley having an axis of rotation extending parallel to an axis of rotation of said storage wheel.

13. A device according to claim 12, wherein a diameter of said guide pulley is smaller than a diameter of said storage wheel.

14. A device according to claim 9, wherein said guide element is a freely rotatable guide pulley having an axis of rotation extending coaxially to an axis of rotation of said storage wheel.

15. A device according to claim 14, wherein said guide pulley is fixedly connected to said storage wheel.

16. A device according to claim 14, wherein a diameter of said guide pulley is smaller than a diameter of said storage wheel.

* * * * *